US007777149B2

(12) United States Patent
Bourgeois et al.

(10) Patent No.: US 7,777,149 B2
(45) Date of Patent: Aug. 17, 2010

(54) ACTUATING THE OPPOSITELY-MOVING CONTACTS OF AN INTERRUPTING CHAMBER BY A CYLINDRICAL CAM

(75) Inventors: Jean-Luc Bourgeois, Lyons (FR); Joël Ozil, St Andre de Corcy (FR); Christophe Creusot, Miribel (FR)

(73) Assignee: Areva T&D SA, Paris la Defense Cedex (FR)

( * ) Notice: Subject to any disclaimer, the term of this patent is extended or adjusted under 35 U.S.C. 154(b) by 485 days.

(21) Appl. No.: 11/888,701

(22) Filed: Aug. 2, 2007

(65) Prior Publication Data

US 2008/0078668 A1 Apr. 3, 2008

(30) Foreign Application Priority Data

Sep. 29, 2006 (FR) ..... 06 54031

(51) Int. Cl.
*H01H 9/00* (2006.01)

(52) U.S. Cl. ..... 218/7; 218/14; 218/78; 218/154

(58) Field of Classification Search ..... 218/2–7, 218/12–14, 17–21, 43–50, 67, 74, 76–80, 218/84, 120, 140, 154
See application file for complete search history.

(56) References Cited

U.S. PATENT DOCUMENTS

| | | | |
|---|---|---|---|
| 2,448,695 | A | 9/1948 | Van Ryan |
| 2,909,633 | A | 10/1959 | Umphrey |
| 3,238,340 | A | 3/1966 | Lerch |
| 3,300,610 | A | 1/1967 | Roth et al. |
| 3,527,912 | A | 9/1970 | Jaillet |
| 3,659,065 | A | 4/1972 | Roidt et al. |
| 3,955,057 | A | 5/1976 | Dabringhausen et al. |
| 4,182,942 | A | 1/1980 | Koyanagi et al. |
| 4,351,993 | A | 9/1982 | Graf |
| 4,459,447 | A | 7/1984 | Arimoto |

(Continued)

FOREIGN PATENT DOCUMENTS

| | | |
|---|---|---|
| DE | 893 684 | 10/1953 |

(Continued)

OTHER PUBLICATIONS

U.S. Appl. No. 11/973,796, filed Oct. 9, 2007, Ozil et al.

(Continued)

*Primary Examiner*—Edwin A. Leon
*Assistant Examiner*—Marina Fishman
(74) *Attorney, Agent, or Firm*—Nixon Peabody LLP

(57) ABSTRACT

In order to reduce the breaking energy of a high-voltage or medium-voltage circuit-breaker, the interrupting chamber (10) contains two contacts (12, 14) mounted to move in opposite directions, actuated via a single device (20, 30). The two contacts (12, 14) are driven in opposite directions by a cylindrical cam (22) having slots (26, 28) that co-operate with fixed rods (32, 42), each of which is connected to a respective one of the contacts (12, 14): the profiles of the slots (26, 28) make it possible to manage the speed and the amplitude of the movement of the second contact (14) relative to the main contact (12) without requiring any complex design.

15 Claims, 2 Drawing Sheets

U.S. PATENT DOCUMENTS

| | | | | |
|---|---|---|---|---|
| 4,577,073 | A | 3/1986 | Talpo | |
| 4,604,508 | A | 8/1986 | Talpo | |
| 4,814,559 | A | 3/1989 | Stegmuller | |
| 5,293,014 | A * | 3/1994 | Perret | 218/57 |
| 5,780,799 | A * | 7/1998 | David | 218/57 |
| 5,898,151 | A | 4/1999 | Plat et al. | |
| 5,905,242 | A | 5/1999 | Bernard et al. | |
| 5,952,635 | A | 9/1999 | Plat et al. | |
| 6,013,888 | A * | 1/2000 | Thuries | 218/14 |
| 6,049,050 | A | 4/2000 | David | |
| 6,429,394 | B2 * | 8/2002 | Hunger et al. | 218/155 |
| 7,199,324 | B2 | 4/2007 | Perret | |
| 7,426,100 | B2 | 9/2008 | Neveu et al. | |

FOREIGN PATENT DOCUMENTS

| | | | |
|---|---|---|---|
| DE | 2 344 352 | | 9/1973 |
| DE | 100 16 950 | | 10/2001 |
| EP | 0 809 269 | | 11/1997 |
| EP | 1 032 009 | A2 | 8/2000 |
| EP | 1 211 706 | A1 | 6/2002 |
| EP | 0 822 565 | B1 | 10/2004 |

OTHER PUBLICATIONS

French Preliminary Seach Report, FR 06 54031, dated Mar. 28, 2007.
U.S. Appl. No. 12/161,314, filed Jul. 17, 2008.

* cited by examiner

ACTUATING THE OPPOSITELY-MOVING CONTACTS OF AN INTERRUPTING CHAMBER BY A CYLINDRICAL CAM

CROSS-REFERENCE TO RELATED PATENT APPLICATION OR PRIORITY CLAIM

This application claims the benefit of a French Patent Application No. 06-54031, filed on Sep. 29, 2006, in the French Intellectual Property Office, the disclosure of which is incorporated herein in its entirety by reference.

TECHNICAL FIELD

The present invention relates to circuit-breakers for high-voltage or medium-voltage, in which the drive energy is reduced by means of the contacts moving in opposite directions.

More particularly, the invention relates to actuating the contacts of an interrupting chamber of a circuit-breaker in opposite directions via a cylindrical cam.

STATE OF THE PRIOR ART

Switchgears for medium voltage or high voltage comprise a pair of contacts mounted to move relative to each other between a closed position in which the electric current can flow and an open position in which the electric current is interrupted.

The speed of separation of the contacts is one of the main parameters for guaranteeing the dielectric performance of the circuit-breaker on opening. In order to reduce the drive energy required while also increasing the speed of separation of the contacts, in particular during breaking performed by a circuit-breaker, it has been proposed to design two moving contacts that are mounted to move relative to each other and that are actuated via a single system.

By convention, the term "main contact" is used to designate an electrical contact (with its anti-corona cap) via which the rated current passes; the term "moving contact" is used to designate the main and arcing contact assembly that is connected directly to the drive member. The "oppositely moving contact", also made up of a main contact and of an arcing contact, is moved via a linkage, which is itself connected to the moving contact.

In particular, Document EP 0 822 565 describes a circuit-breaker for high voltage or medium voltage that has a lever having two arms, one arm being connected to a nozzle secured to or integral with a first contact and the other arm being connected to a second contact, that lever making it possible for the movement of the first contact to drive the second contact simultaneously in the opposite direction.

However, it can be seen that the speed ratio on contact separation plays an important part while current is being broken and while the resulting arc is striking. Unfortunately such lever actuation does not make it possible to modify that ratio.

One solution to that problem has been to use a cam mechanism, as described in Document EP 1 211 706: the nozzle secured to or integral with the first arcing contact is connected, via a rod, to a pivotally mounted cam. During triggering, the cam drives a second rod that is connected to the second arcing contact, so that the first contact moving in a first direction causes the second contact to move in the opposite direction.

That solution makes it possible, by means of the shapes of the cam guide surfaces, to obtain a speed ratio that varies during the movement of the contacts. However, that system is complex to construct and the pivotal movement of the cam, accompanied by the guiding of the rods in the guide surfaces can pose problems of reliability over time, in particular due to loss of adjustment of the positions of the various axes of movement.

SUMMARY OF THE INVENTION

Among other advantages, the invention proposes to overcome the above-described drawbacks, and making it possible, in particular, to obtain improved reliability for an interrupting chamber in which the contacts move in opposite directions.

In one of its aspects, the invention thus provides the use of a cylindrical cam for moving two contacts of an interrupting chamber in opposite directions: the movement of the main contact in one direction causes a cylinder to move in rotation, thereby causing the oppositely moving second contact to move in the opposite direction; in one option, actuation of the cylinder itself causes the two contacts to move in opposite directions. Each of the contacts is connected via a respective rod that is fastened to an element that is mounted to slide in a respective slot in the cylinder.

The slots are designed to obtain a specific speed ratio. In particular, the slot for driving the main contact can include portions of different inclinations relative to the axis, and, in particular, at least one longitudinal end portion extending along the axis: when the main contact is caused to start moving, the cylinder is caused to wait for a latency time before moving in rotation so long as the slidably mounted element is moving along said end portion, e.g. so as to allow the contact to reach a certain speed before separation occurs.

In a preferred aspect, the invention provides an interrupting chamber for a high-voltage or medium-voltage circuit-breaker, said interrupting chamber containing two contacts that are mounted to move relative to each other in opposite directions along an axis, and that are held by a contact holder which is preferably symmetrical about the axis of movement of the contacts. The two contacts are connected to a drive cylinder by connection means, in particular rods each of which is fastened to the respective contact via one of its ends, the drive cylinder being provided with slots in which slidably mounted elements secured to the other ends of the rods can move. Advantageously, a dielectric nozzle is secured to the main contact, and serves as a point for fastening to the corresponding connection means.

Preferably, the drive rods for driving a contact, and in particular the main contact, are provided in pairs, one end of each rod being fastened to the contact so that the rods are fastened thereto in diametrically opposite manner, and the rods advantageously being interconnected at their other ends by a bar that extends orthogonally to them and that is mounted to slide in two symmetrical slots in the cylinder. This configuration makes it possible to limit the forces on the contacts and/or on the nozzle.

Advantageously, at least some of the slidably mounted elements are coupled to snugs that are also mounted to slide in guide grooves provided in the contact holder of the interrupting chamber. The grooves are parallel to the axis of rotation, so that movement in translation only is imparted to the connection means and thus to the contacts.

In another aspect, the invention relates to a high-voltage or medium-voltage circuit-breaker provided with an interrupting chamber in which the contacts are driven via a cylindrical cam.

BRIEF DESCRIPTION OF THE DRAWINGS

The characteristics and advantages of the invention can be better understood on reading the following description and on examining the accompanying drawings which are given merely by way of non-limiting illustration, and in which.

DETAILED DESCRIPTION OF PARTICULAR EMBODIMENTS

Figure 1A:
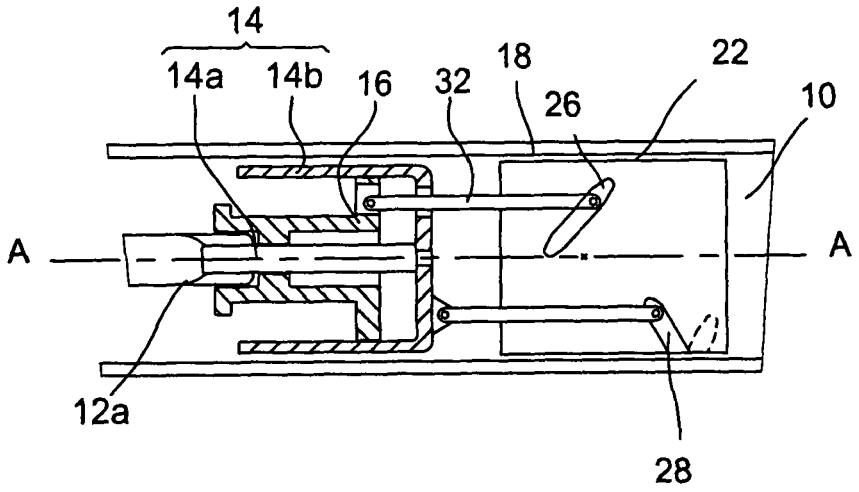
FIGS. 1A and 1B are diagrams of an interrupting chamber provided with oppositely moving contacts driven by an embodiment of a drive device of the invention, shown respectively in the closed position and in the open position.
Figure 1B:
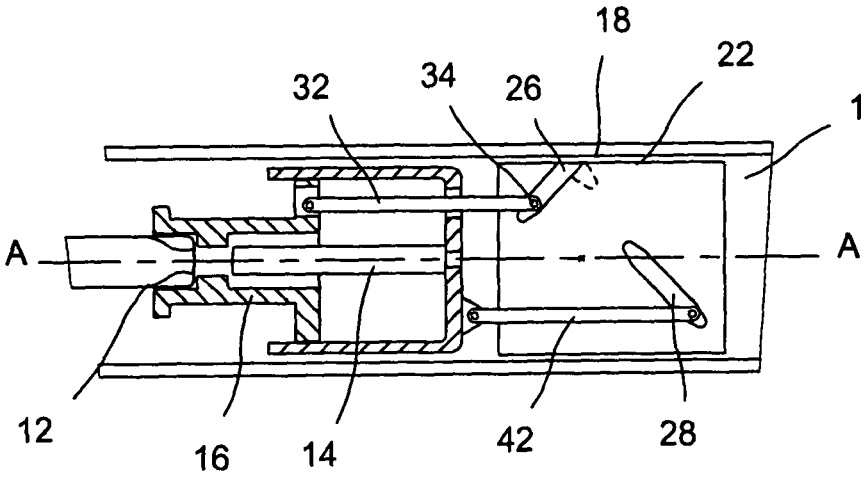

A high-voltage or medium-voltage circuit-breaker includes an interrupting chamber 10 which can be filled with a dielectric gas of the sulfur hexafluoride ($SF_6$) type. The interrupting chamber 10 contains a first contact 12 and a second contact 14; the moving first contact 12 is made up of an arcing contact 12*a* and of a main contact (not shown), and an oppositely moving second contact 14 is also made up of an arcing contact 14*a* and of a main contact 14*b*. Conventionally, the first contact 12 has a pluggable bushing shaped portion and the second contact has a cylindrically shaped portion that can be inserted into the pluggable bushing: these two elements co-operate between a closed position (FIG. 1A) in which they allow electrical current to pass between them and an open position (FIG. 1B) in which they are separated from each other.

During the breaking procedure, the two contacts 12, 14 move in opposite directions; the main contacts 14*b* separate, and then the arcing contacts 12*a*, 14*a* separate, after a latency period, if any, generated by the length of the mutual engagement, forming an electric arc that is extinguished by the contacts 12, 14 subsequently being moved further apart. In order to improve this arc extinction, the main contact, which is the first contact 12 in this example (even though, in particular in the claims, it could be the second contact 14) is usually secured to a nozzle 16 which is made of an insulating material and which extends the pluggable bushing 12 towards the second contact 14, which itself extends a gas compression volume; said dielectric nozzle 16 that forms a neck serves as a blast nozzle for blasting the gas coming from the compression volume towards the electric arc, and can, for example, make it possible for degassing to occur in the presence of an electric arc and take part in blasting the arc.

Other systems can also be provided, such as, for example gas blasting and compression chambers.

The two contacts 12, 14 and the nozzle 16 are guided inside a permanent contact holder 18 along the main axis AA of the interrupting chamber 10 of the circuit-breaker. Preferably, the interrupting chamber 10, the nozzle 16, the first and second contacts 12, 14 are symmetrical around the axis AA; the contact holder 18 can take various usual forms, in particular they can be in the form of two diametrically opposite rails or of four rails spaced apart by 90°, or of a cylindrical casing.

Each of the contacts 12, 14 is actuated to move away from or towards the other contact via a single actuation system comprising a drive member (not shown) and drive means 20. Conventionally, the main contact 12 being moved by the drive member during triggering of the circuit-breaker drives drive means 20 that move the secondary contact 14; one option is for the drive member to actuate the drive means 20 that cause the contacts 12, 14 to move in opposite directions.

In accordance with the invention, the drive means 20 comprise a cylindrical element 22 that is circularly symmetrical about the axis AA of the chamber 10, that is advantageously located in the contact holder 18 on the same side as the second contact 14, i.e. along the axis AA, the elements are in the following order: main contact 12, nozzle 16, secondary contact 14, and cylinder 22. The drive cylinder 22 preferably has only one degree of freedom, namely movement in rotation around the axis AA; for example, two locking systems 24, such as rolling bearings or some other type of bearings, are disposed on either side of the cylinder 22 along the axis AA (see FIG. 2A).

The cylinder 22 acts in the manner of a cam; it is provided with drive slots 26, 28 that pass through its wall with a predetermined profile, at least a portion of each slot having a slope relative to the direction of the axis AA, i.e. winding around the axis AA, forming a substantially helical shape.

The two contacts 12, 14 are driven in opposite directions, the contacts 12, 14 being secured to the slots via connection means 30. The first slot 26 dedicated to driving the first contact 12 thus has a sloping portion whose angle is of sign opposite to the sign of the angle of the slope of the second slot 28 that is dedicated to driving the second contact 14.

In addition, in order to avoid any interaction between the connection means 30 of each of the contacts 12, 14 with its slot 26, 28 during the movement, in order to facilitate assembly, and in order to avoid unnecessarily weakening the cylinder 22, it is preferable for the drive slots 26, 28 of each of the contacts 12, 14 to be formed entirely in a dedicated portion of the cylinder 22. In the preferred embodiment in which the cylinder is on the same side as the second contact 14, in order to compensate for the difference in length of the connection means 30, an example of a configuration thus comprises a first slot 26 serving, during actuation of the first contact 12, and having a substantially helical portion that winds, for example, clockwise over a first end portion of the cylinder 22 closer to the contacts 12, 14, then the second end portion of the cylinder 22, further from the contacts 12, 14 along the axis AA, is provided with a second slot 28 which has a substantially helical portion that winds counterclockwise.

The connection between the first contact 12 and the drive device 20 is advantageously implemented by a rod 32 having one end fastened to the first contact 12, or preferably to the nozzle 16. The rod 32 is allowed to move in translation only parallel to the axis AA, e.g. by being bolted to the nozzle 16. The rod 32 is secured at its second end to a slidably mounted element 34 that co-operates with the first slot 26: the first contact 12 and the nozzle 16 moving in the translation causes, e.g. via a known drive member, the rod 32 to move in translation along the axis AA, and the slidably mounted element 34 to move inside the slot 26, thereby causing the cylinder 22 to move in rotation.

Figure 2A:
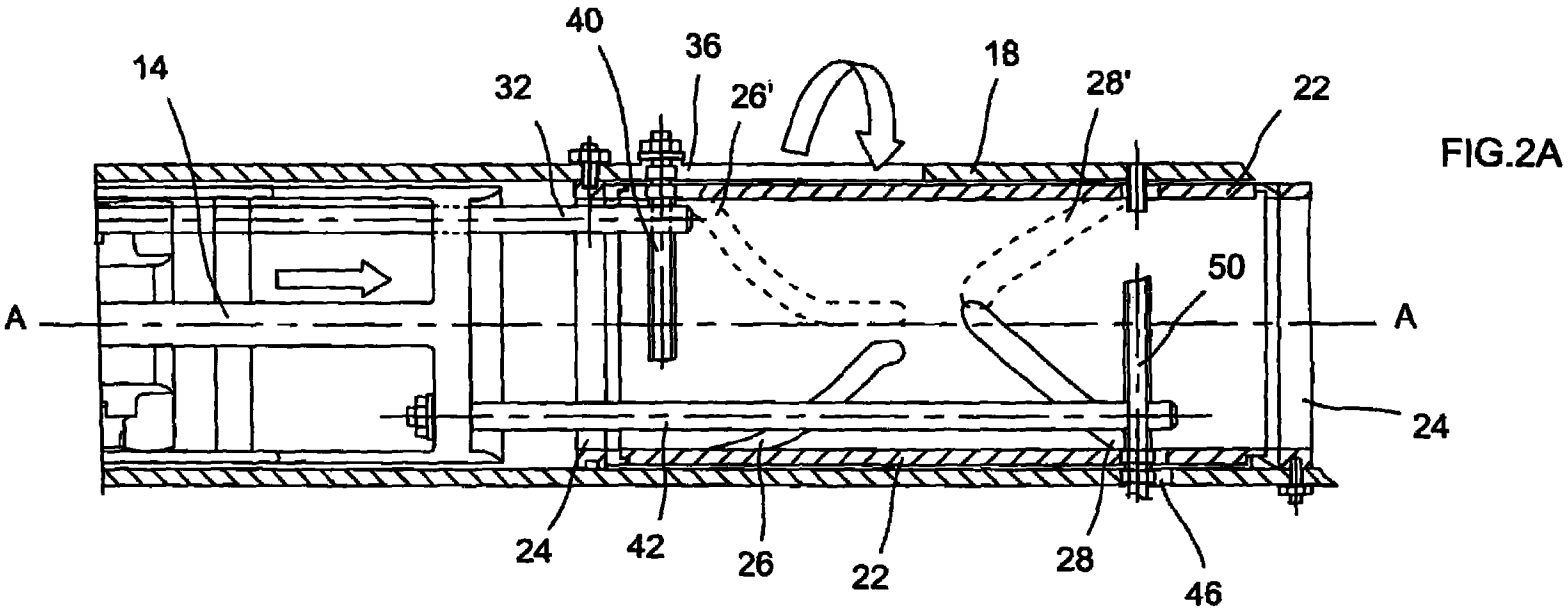
FIG. 2A shows, more precisely, a preferred embodiment of a drive system of the invention.

In order to avoid any parasitic movement, and in particular in order to avoid any movement in rotation of the element 34 accompanied by twisting of the rod 32, the slidably mounted element 34 is preferably guided in a groove 36 provided in the stationary contact holder 18, e.g. via a snug 38 that extends it; the groove 36 is parallel to the direction of movement of the contact 12, i.e. parallel to the axis AA (FIG. 2A). Various configurations can be provided for the snug 38, but it is desirable for it to be locked in the groove 36 to a greater or lesser extent; e.g. the groove 36 presents an internally widened portion in the wall of the contact carrier 18 where said groove is formed, and the snug 38 presents a protuberance which is held therein. The rod 32 is advantageously located inside the cylinder 22 so as to have greater freedom in designing the shape of the slots 26, 28 by means of a diameter that is greater and thus of a developed surface that is larger; advantageously, the cylinder 22 has an outside diameter close to the inside diameter of the contact holder 18 or to the outside diameter of the contacts or nozzle 12, 14, 16.

Figure 3A:
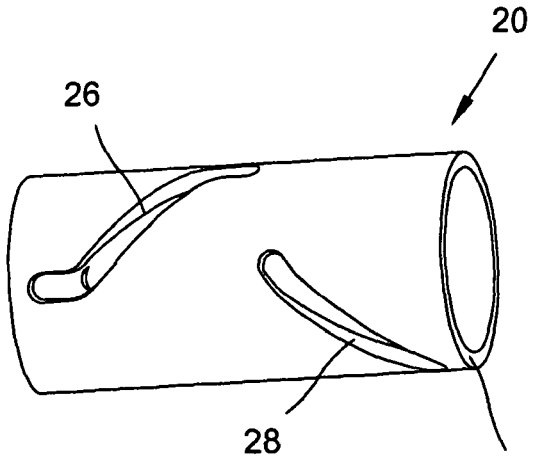
FIGS. 3A and 3B are views of an embodiment of a drive cylinder of the invention.
Figure 3B:
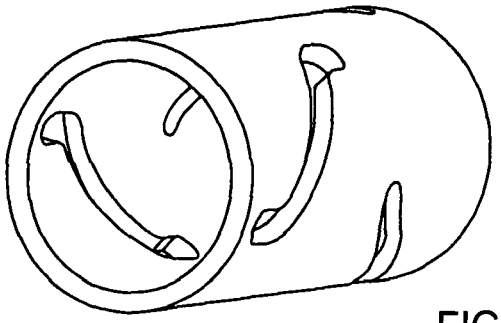
Figure 2B:
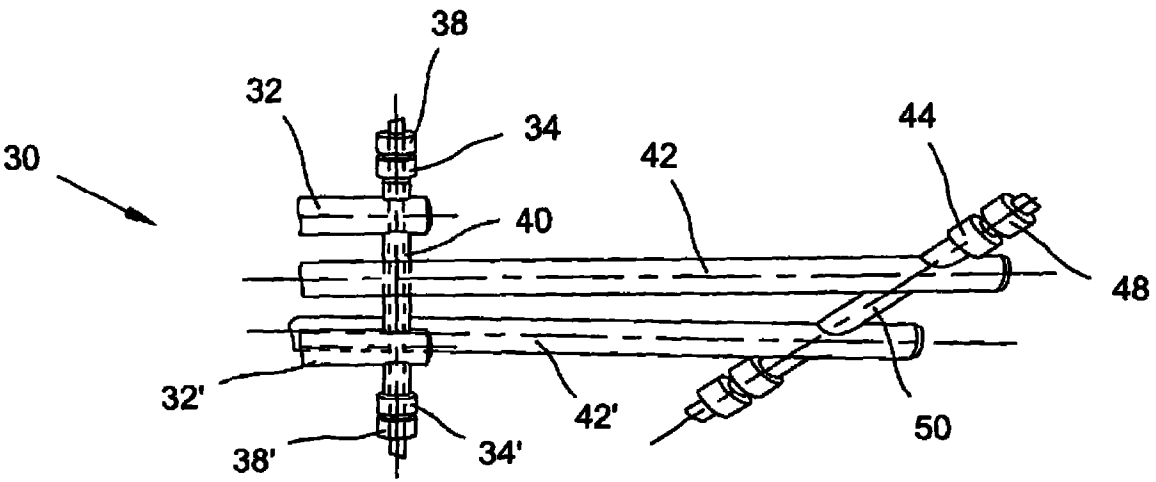
FIG. 2B shows the associated connection means.

In addition, in order to balance the forces on the nozzle 16 and on the contact 12, it is advantageous to have two connection rods 32, 32' fastened in diametrically opposite manner and co-operating with two first slots 26, 26' having the same shape and offset by 180° on the cylinder 22 (FIGS. 2 and 3). In that case, it is preferable, in order to increase further the symmetry and the rigidity, for the rods 32, 32' also to be held spaced apart at the actuating ends, by interconnecting the two rods 32, 32' and the slidably mounted elements 34, 34' by a bar 40 which passes through the cylinder 22. The bar 40 is then fastened perpendicularly to the rods 32, 32', and thus perpendicularly to the axis AA, and it includes the two slidably mounted elements 34, 34' and preferably two snugs 38, 38' that co-operate with two guide rails 36, 36' that are diametrically opposite on the contact holder 18.

As regards the second contact 14, the same drive and connection geometry is advantageously implemented, with two second rods 42, 42' coupled at one end in fixed manner to the second contact 14, and secured at the other end to elements 44, 44' mounted to slide in two second slots 28, 28' in the cylinder 22. A second bar 50 that is perpendicular to the rods 42, 42' holds them spaced apart and co-operates at either end with respective ones of two guide rails 46, 46' on the contact holder 18 via two snugs 48, 48'.

Preferably, in order to optimize the rigidity of the cylindrical cam 22, the two holding bars 40, 50 are perpendicular to each other.

It is possible however for the second contact 14 to be driven only via a single second rod 42, even if the first contact 12 drives two first rods 32, 32'. Other configurations are also possible, as a function of overall size, forces present, etc.

The profiles of the first and second slots 26, 28 make it possible to manage the strokes of the two contacts 12, 14 relative to each other; more precisely, they make it possible to optimize the stroke of the second contact 14 relative to the stroke of the main contact 12. The speed and the amplitude of the movement in rotation of the cylinder 22 depend on the speed of the main contact 12 during triggering of the circuit-breaker and on the profile of the (each) first slot 26. The movement in rotation of the cylinder 22 and the profile of the (each) second slot 28 make it possible to define the amplitude and the speed of movement of the second moving contact 14.

For example, it is desirable to have a sum of the speeds of the two contacts 12, 14 that is at its maximum after separation of the contacts, in order to optimize opening energy. A slot profile that is adapted for the slots 26, 28 is shown in FIG. 3, in which it can be observed that each first slot 26 has, at either end, first portions that are parallel to the axis AA: at the beginning of actuation, in particular, the main contact 12 gathers speed while remaining in the closed position, and it is unnecessary for the cylindrical cam 22 to move in rotation; once a certain speed is reached, the second contact 14 is driven so as to obtain a maximum speed, during separation and on arcing, and the two slots 26, 28 extend at angles that are almost opposite from each other.

Various geometrical shapes are possible.

Actuation of the invention is easy to implement by using parts that are simple to manufacture and with tolerances that are increased by the various means making it possible to guarantee that the movement takes place in the desired direction, such as the rails 35, 46, the snugs 38, 48, the bars 40, 50, etc. The solution of the invention makes it possible to define a contact movement profile for the contacts 12, 14 that is optimized, i.e. to manage as well as possible the stroke and the speed of movement of the oppositely moving second contact 14 relative to the main contact 12, without using complex configuration computations, and said solution of the invention makes assembly easy.

In addition, the interrupting chamber 10 can remain of the same overall axial size, which is advantageous, in particular for an $SF_6$ circuit-breaker.

The invention claimed is:

1. An interrupting chamber for a high-voltage or medium-voltage circuit-breaker, said interrupting chamber extending longitudinally along an axis, and containing at least:

first and second contacts mounted to move along the axis and moving in opposite directions relative to each other, between a closed position in which they are in mutual contact and an open position in which they are separated; and drive means making it possible to move the two contacts;

connection means between each of the contacts and the drive means;

in which:

the drive means comprise a hollow cylinder mounted to move in rotation around the axis of the chamber;

in its wall, the cylinder presents at least a first slot and a second slot, each of which has a portion inclined at an angle of opposite sign relative to the axis;

the connection means of the first contact comprise a first slidably mounted element co-operating with said first slot, and the connection means of the second contact comprise a second slidably mounted element cooperating with said second slot;

so that, when the cylinder moves in rotation around the axis, the first and second slidably mounted elements move in their respective slots in translation and in opposite directions along the axis of rotation of the cylinder.

2. An interrupting chamber according to claim 1, containing a drive member that is functionally connected to the first contact so as to move it, thereby moving the cylinder in rotation and moving the second contact in translation in the opposite direction.

3. An interrupting chamber according to claim 1, in which the connection means of both of the contacts are of identical type.

4. An interrupting chamber according to claim 1, in which the connection means of the first contact comprise a first rod fastened at one end to the first sliding element and secured at its other end to the first contact in fixed manner.

5. An interrupting chamber according to claim 4, in which the cylinder is provided with two first slots having the same shape and offset by 180° relative to each other about the axis, and in which the connection means of the first contact comprise two first rods one end of each of which is connected in fixed manner to the first contact in diametrically opposite manner, and the other end of each of which is fastened to a first slidably mounted element that co-operates with one of the first slots.

6. An interrupting chamber according to claim 5 containing a connection bar interconnecting the first slidably mounted elements and fastened perpendicularly to the rods.

7. An interrupting chamber according to claim 6, in which the wall of the cylinder is provided with two second slots and the second connection means comprise a second bar mounted to slide in the second slots, the two bars forming an angle of 90°.

8. An interrupting chamber according to claim 1, containing a longitudinal contact holder which is extended along the cylinder and in which at least one of the sliding elements is extended by a snug that co-operates slidably with a guide groove in the contact holder of the chamber.

9. An interrupting chamber according to claim 8, in which each guide groove is linear along the axis.

10. An interrupting chamber according to claim 1, further containing a nozzle made of a dielectric material that is coupled in fixed manner to a main one of the contacts.

11. An interrupting chamber according to claim 10, in which the connection means of the main contact are secured directly to the nozzle.

12. An interrupting chamber according to claim 1, in which the cylinder is locked in translation along the axis.

13. An interrupting chamber according to claim 1, in which the profile of the first drive slots for driving the first contact is different from the profile of the second drive slots for driving the second contact.

14. An interrupting chamber according to claim 13, in which the first drive slot(s) for driving the first contact include (s) at least one end portion that is parallel to the axis of rotation.

15. A high-voltage or medium-voltage circuit-breaker including an interrupting chamber according to claim 1.

* * * * *